US009296005B2

(12) United States Patent
Hu et al.

(10) Patent No.: US 9,296,005 B2
(45) Date of Patent: Mar. 29, 2016

(54) NOZZLE REPLACEABLE ATOMIZER WITH AUTOMATIC ABNORMALITY DETECTING FUNCTION

(71) Applicants: Chin Chien Hu, Taichung (TW); Jih Wen Wang, Taichung (TW); Ting-Kuo Chen, Taichung (TW); Jey Jey Huang, Taichung (TW)

(72) Inventors: Chin Chien Hu, Taichung (TW); Jih Wen Wang, Taichung (TW); Ting-Kuo Chen, Taichung (TW); Jey Jey Huang, Taichung (TW)

(73) Assignees: MOI Global Corporation Ltd., Taichung (TW); Liga Precision Technology Co., Ltd., Taichung (TW)

( * ) Notice: Subject to any disclaimer, the term of this patent is extended or adjusted under 35 U.S.C. 154(b) by 0 days.

(21) Appl. No.: 14/572,799

(22) Filed: Dec. 17, 2014

(65) Prior Publication Data

US 2015/0102124 A1 Apr. 16, 2015

(51) Int. Cl.

| | |
|---|---|
| ***B67D 5/08*** | (2006.01) |
| ***B05B 17/00*** | (2006.01) |
| ***B05B 12/08*** | (2006.01) |
| ***B05B 15/02*** | (2006.01) |

(52) U.S. Cl.

CPC ..... *B05B 17/0646* (2013.01); *B05B 12/08* (2013.01); *B05B 12/081* (2013.01); *B05B 15/02* (2013.01)

(58) Field of Classification Search

CPC .... B05B 17/0607; B05B 12/02; B05B 12/004
USPC ..... 239/69, 71, 102.1, 102.2
See application file for complete search history.

(56) References Cited

U.S. PATENT DOCUMENTS

| | | | | |
|---|---|---|---|---|
| 4,044,297 | A * | 8/1977 | Nobue | B05B 17/0623 239/102.2 |
| 5,138,513 | A * | 8/1992 | Weinstein | H02H 7/003 361/2 |
| 6,144,570 | A * | 11/2000 | Hughey | B05B 5/10 363/26 |
| 2014/0151471 | A1* | 6/2014 | Dau | B05B 5/0533 239/696 |

* cited by examiner

*Primary Examiner* — Davis Hwu

(57) ABSTRACT

A nozzle replaceable atomizer with automatic abnormality detecting function is provided. In the atomizer, when a detachable spray head is assembled to a main machine, a microcomputer serves to automatically set a piezoelectric element at an optimal operating frequency. When working at the optimal operating frequency that allows resonance, the piezoelectric element has the least impedance and the current/voltage phase difference of zero. During the operation of the atomizer, once the current/voltage phase-comparing circuit notices that the current/voltage phase difference is not zero or not close to zero, the microcomputer triggers a frequency-tracing prompter to inform a user that a frequency-tracing switch has to be operated to redefine the operating frequency of the piezoelectric element. If repeated adjustments have been done as failure and the frequency-tracing prompter keeps giving prompts, the user can be sure that the spray head needs to be maintained or replaced.

6 Claims, 5 Drawing Sheets

NOZZLE REPLACEABLE ATOMIZER WITH AUTOMATIC ABNORMALITY DETECTING FUNCTION

BACKGROUND OF THE INVENTION

1. Field of the Invention

The invention relates to atomizers, and more particularly to a nozzle replaceable atomizer with automatic abnormality detecting function that can automatically detect abnormal operation for a user to easily determine whether its spray head has to be fixed or replaced, thereby providing convenient management and maintenance for normal nebulization.

2. Description of Related Art

As MEMS (Micro Electro-Mechanical System) technology has advanced rapidly, the recently developed drug dispensing atomizers are made to generate extremely fine mist of medicine particles that is helpful to enhance inhalation and curative effects. These atomizers are made portable and thus are convenient for various patients to use. However, a spray head on the known atomizer tends to get clogged after long-term use and its cleaning is troublesome. As an improvement, atomizers with replaceable spray nozzles have been proposed for ensuring not only normal nebulization, but also use hygiene and safety.

The atomizers with replaceable spray nozzles, however, have their challenges. For example, one technical issue encountered when it comes to replacement of spray nozzles is about the piezoelectric enabling element of the spray nozzle. Since different materials and different porous metal nozzle plates have different (inconsistent) vibrational properties, it is essential to have the piezoelectric element properly adjusted in terms of operating frequency, or normal nebulization is impossible. For addressing this issue, a known scheme proposed is about directly getting feedback signals from the piezoelectric element (by using, for example, a vibration sensor) and accordingly performing frequency adjustment, yet the feedback signals are usually not accurate enough and likely to lead to fault detection. As a further improvement, a disclosure discloses a nebulizing device with a detachable spray nozzle, wherein variable resistance or variable capacitance (to be manually adjusted) is used to properly set the operating frequency for the piezoelectric element. Nevertheless, in practical use, users (consumers) of the atomizer when doing adjustment without the aid of any electric detecting instruments has no scientifically-proven data as reference and can hardly identify the optimal operating frequency. Given the required manual adjustment and uncertain adjusted results, this known approach is somehow inconvenient.

Another disclosure discloses an adjusting method and structure for resonance frequency of a demounting type spray head of an atomizer. It implements microcomputer frequency tracing technology to automatically align the operating frequency the piezoelectric element with its resonance frequency, and effectively eliminates the inconvenience and inaccuracy related to manual adjustment. The frequency tracing technology can fix the newly assembled spray nozzle to the aligned operating frequency, and secure the piezoelectric element to work with this frequency throughout all sequent spray sessions. However, in the event that the piezoelectric element or the nozzle plate becomes unable to atomize the liquid it sprays to the desired level, the atomizer provides no means to detect this situation and readjust the operating frequency of the piezoelectric element accordingly.

It is known that good medicine inhalation and curative effects depend on the fine mist of atomized medicine generated by atomizers. As an untrained user is usually unable to tell the subtle difference between the original and degraded nebulization by his/her bear eyes, the deterioration can remain undetected until more significant difference occurs and this means a long period of ineffective or poor inhalation treatment has lapsed. For example, a nozzle plate is gradually clogged over a long period opposite to being blocked to the extent that it shows obvious abnormality instantly. Generally, once the nozzle plate is clogged, even slightly, the frequency on which it combines with the piezoelectric element begins or has begun to change, and the original operating frequency fixed by the microcomputer may become or have become no more optimal for resonance, leading to deterioration of nebulization.

The deterioration increases and becomes more obvious as the nozzle plate is clogged more seriously. When the nebulization is too poor and it is found that the spray nozzle has to be replaced, the piezoelectric element may have worked with a non-resonant frequency for a considerable period. Consequently, the user using this atomizer receives little or no treatment through inhalation during this period. Therefore, it would be desired that the atomizer can keep checking whether the operating frequency of its piezoelectric element reaches resonance throughout operation and timely readjust the operating frequency to compensate any deterioration. Additionally, in an atomizer capable of detecting whether its piezoelectric element works on resonance, as long as the abnormality of the piezoelectric element related to misalignment to the resonance frequency is not caused by serious deformation, breakage, or manufacturing/assembling defects of the piezoelectric element and/or the nozzle plate, it can be corrected by using a microcomputer in the atomizer to use frequency tracing function to realign the operating frequency with the current resonance frequency, so the atomizer can always works normally. Thus, it would be desired to have an atomizer whose nozzle is replaceable. The atomizer preferably uses frequency tracing technology as a breakthrough to address the need of adjustment for resonance, and is capable of detecting whether its piezoelectric element is operating in a resonant state.

SUMMARY OF THE INVENTION

One primary objective of the invention is to provide a nozzle replaceable atomizer with automatic abnormality detecting function, the atomizer comprising: a detachable spray head, having a nozzle containing therein a spray-generating portion that includes a piezoelectric element and a nozzle plate; a main machine, having an assembling portion for electrically interfacing the spray head, and having a battery to provide a circuit board therein with working power, wherein the circuit board comprises: a microcomputer, providing a spraying switch, a frequency-tracing switch and a frequency-tracing prompter at a surface of the main machine; a power amplifying unit, taking the microcomputer as a signal input end thereof and having a bipolar output end electrically connected to the piezoelectric element in the spray head, wherein there is a resistor connected in series and two resistors connected is parallel along lines of the bipolar output end; a current-feedback-signal generating unit, detecting variation of an electric signal across two ends of the resistor connected in series between the power amplifying unit and the piezoelectric element, and outputting a current-feedback signal to the microcomputer; a voltage-feedback-signal generating unit, being electrically connected to the two resistors connected in parallel between the power amplifying unit and detecting the piezoelectric element so as to detect variation of an electric signal between the two resistors; and a current/ voltage phase-comparing circuit, obtaining a current-waveform feedback signal form the current-feedback-signal generating unit and obtaining a voltage-waveform feedback signal from the voltage-feedback-signal generating unit, and accordingly generating and outputting a signal for determining current/voltage phase difference for the microcomputer; and a liquid refill, being connected to one end of the spray-generating portion of the spray head, and having internally a liquid reservoir that is communicated with the spray-generating portion for replenishing a liquid. Thereby when a detachable spray head is assembled to the main machine, the frequency-tracing switch operates the microcomputer to send out a preset frequency and plural detecting frequencies. The current-feedback-signal generating unit outputs a current-feedback signal for the microcomputer to perform frequency tracing or comparison, so as to automatically set the piezoelectric element at an optimal operating frequency. According to the rule that when the frequency of the AC power output by the power amplifying unit is equal to the natural frequency of the piezoelectric element and resonance is achieved, the piezoelectric element has the least impedance and the current/voltage phase difference is zero, during the operation of the atomizer activated by the spraying switch, once the current/voltage phase-comparing circuit notices that the current/voltage phase difference is not zero or not close to zero, the microcomputer triggers a frequency-tracing prompter to inform a user that a frequency-tracing switch has to be operated to redefine the operating frequency of the piezoelectric element. If repeated adjustments have been done as failure and the frequency-tracing prompter keeps giving prompts, the user can be sure that the spray head needs to be maintained or replaced. Thereby, the normal operation of the atomizer can be conveniently managed and maintained in virtue of the automatic frequency-abnormality detection.

Another objective of the invention is to provide a nozzle replaceable atomizer with automatic abnormality detecting function, wherein the circuit board in the main machine further comprises a battery-level detecting circuit that detects a remaining power level of the battery, and has a signal output end electrically connected to the microcomputer, in which the microcomputer provides a power reminder at the surface of the main machine. Thereby, when the battery level becomes low and may hinder the piezoelectric element from normal operation, the battery-level detecting circuit can detect this situation and let the microcomputer trigger the power reminder to inform the user that the battery needs to be replaced with a new one, or the atomizer may fail to work. The power reminder may be a light-emitting diode that can be turned on to flash or illuminate by the microcomputer, so as to indicate that the battery power is about to be low or has been low.

Another objective of the invention is to provide a nozzle replaceable atomizer with automatic abnormality detecting function, wherein the circuit board in the main machine further comprises a liquid-level detecting circuit, and the liquid reservoir of the liquid refill contains a liquid-level sensor acting as an output end of the liquid-level detecting circuit, in which the output end of the liquid-level detecting circuit is electrically connected to the microcomputer and the microcomputer provides a liquid-level reminder at the surface of the main machine. Thereby, when the liquid in the liquid reservoir of the liquid refill gets consumed to a certain extent, the liquid-level detecting circuit can output a low-level signal to the microcomputer according to the detection of the liquid level in the liquid reservoir performed by the liquid-level sensor, so that the microcomputer can trigger the liquid-level reminder, to inform that refilling needs to be done. When the liquid reservoir is almost empty, the microcomputer can even stops the spraying switch and automatically turns off the piezoelectric element, so as to prevent the piezoelectric element and/or the nozzle plate from getting damaged due to waterless operation. The liquid-level reminder may be a light-emitting diode that can be turned on to flash or illuminate by the microcomputer, so as to indicate that refilling of the liquid is needed or that nebulization has stopped due to the low liquid level.

Another objective of the invention is to provide a nozzle replaceable atomizer with automatic abnormality detecting function, wherein the frequency-tracing prompter provided by the microcomputer at the surface of the main machine is a light-emitting diode that can be turned on to flash or illuminate by the microcomputer, so as to indicate that the piezoelectric element is not operating at the operating frequency or has failed.

The above and other objects, features and advantages of the invention will become apparent from the following detailed description taken with the accompanying drawings.

DETAILED DESCRIPTION OF THE INVENTION

Figure 1:
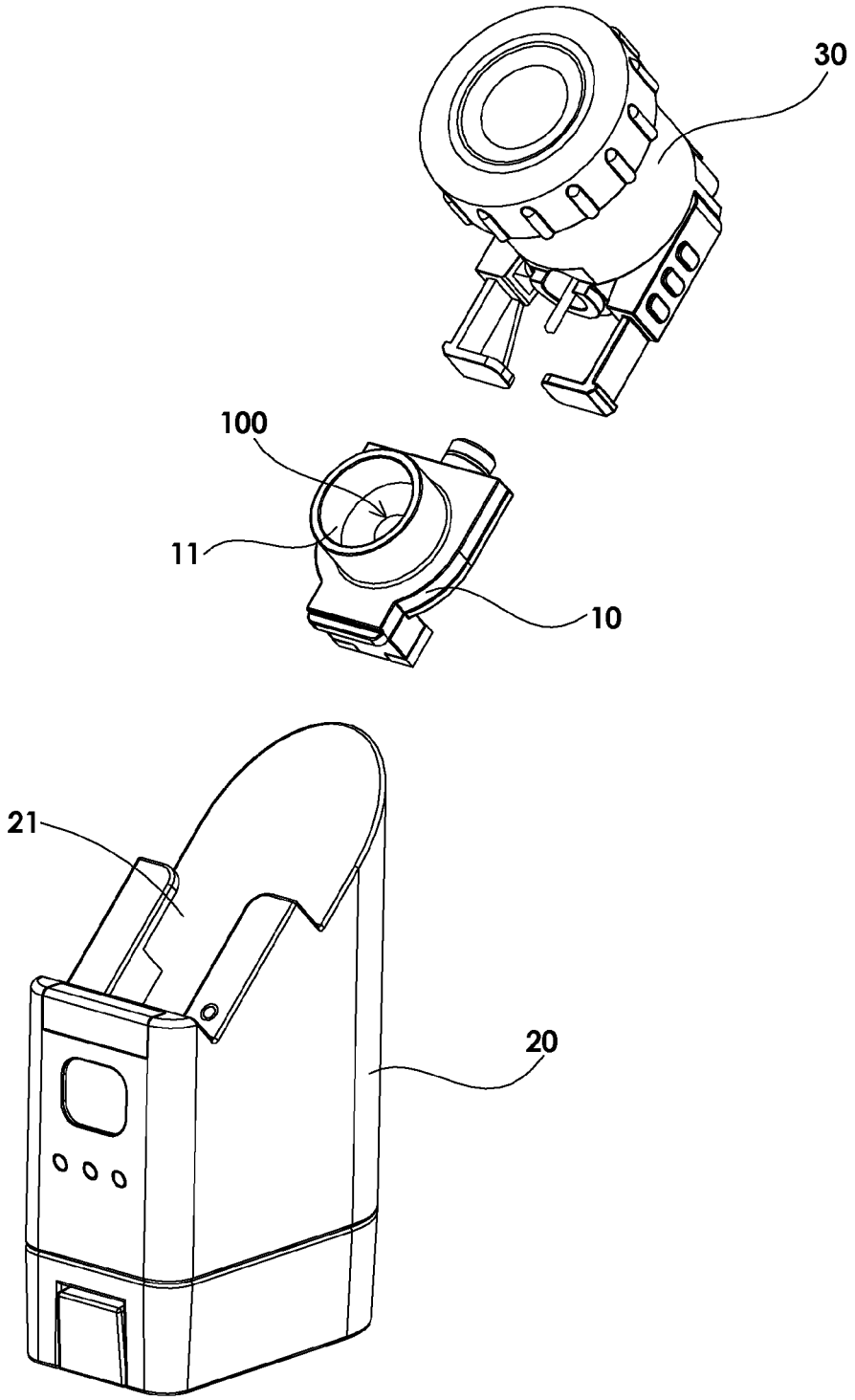
FIG. 1 depicts an atomizer of one embodiment of the invention, showing that its spray head is detached.
Figure 2:
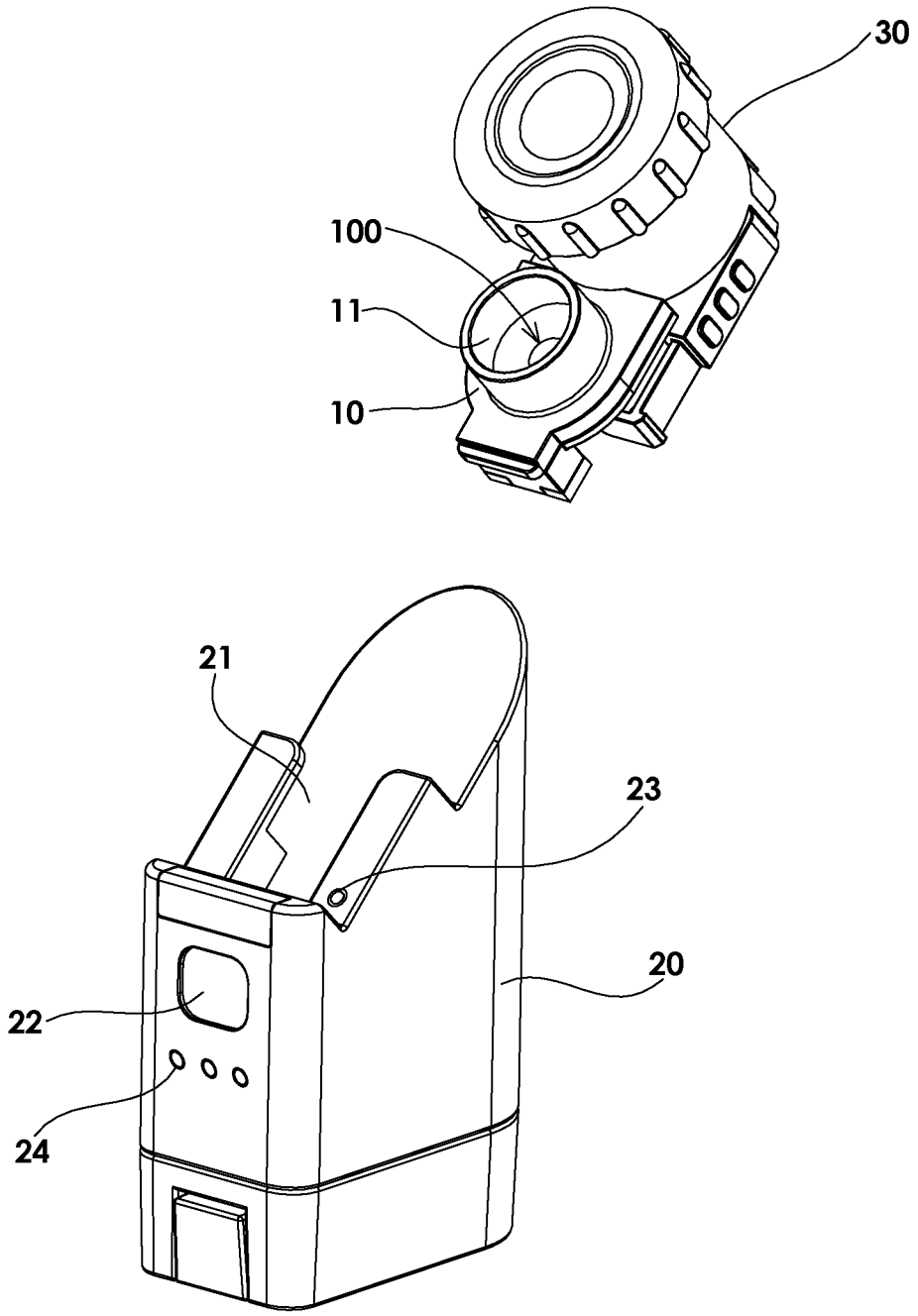
FIG. 2 depicts the atomizer of FIG. 1, showing that its spray head and its liquid refill are combined and to be assembled to its main machine.
Figure 3:
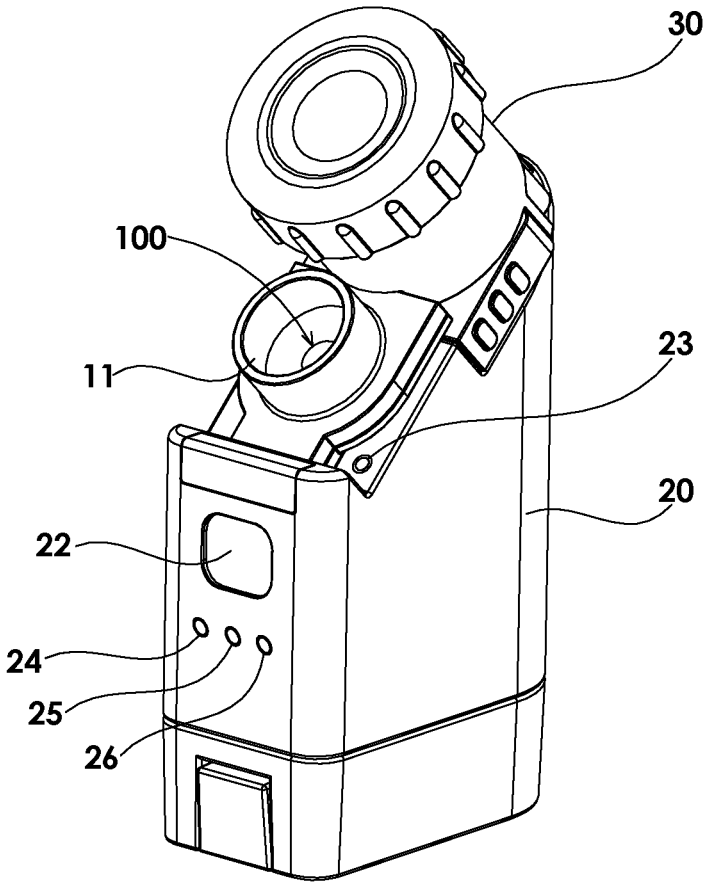
FIG. 3 depicts the atomizer of FIG. 1, showing that the spray head and the main machine assembled together.
Figure 4:
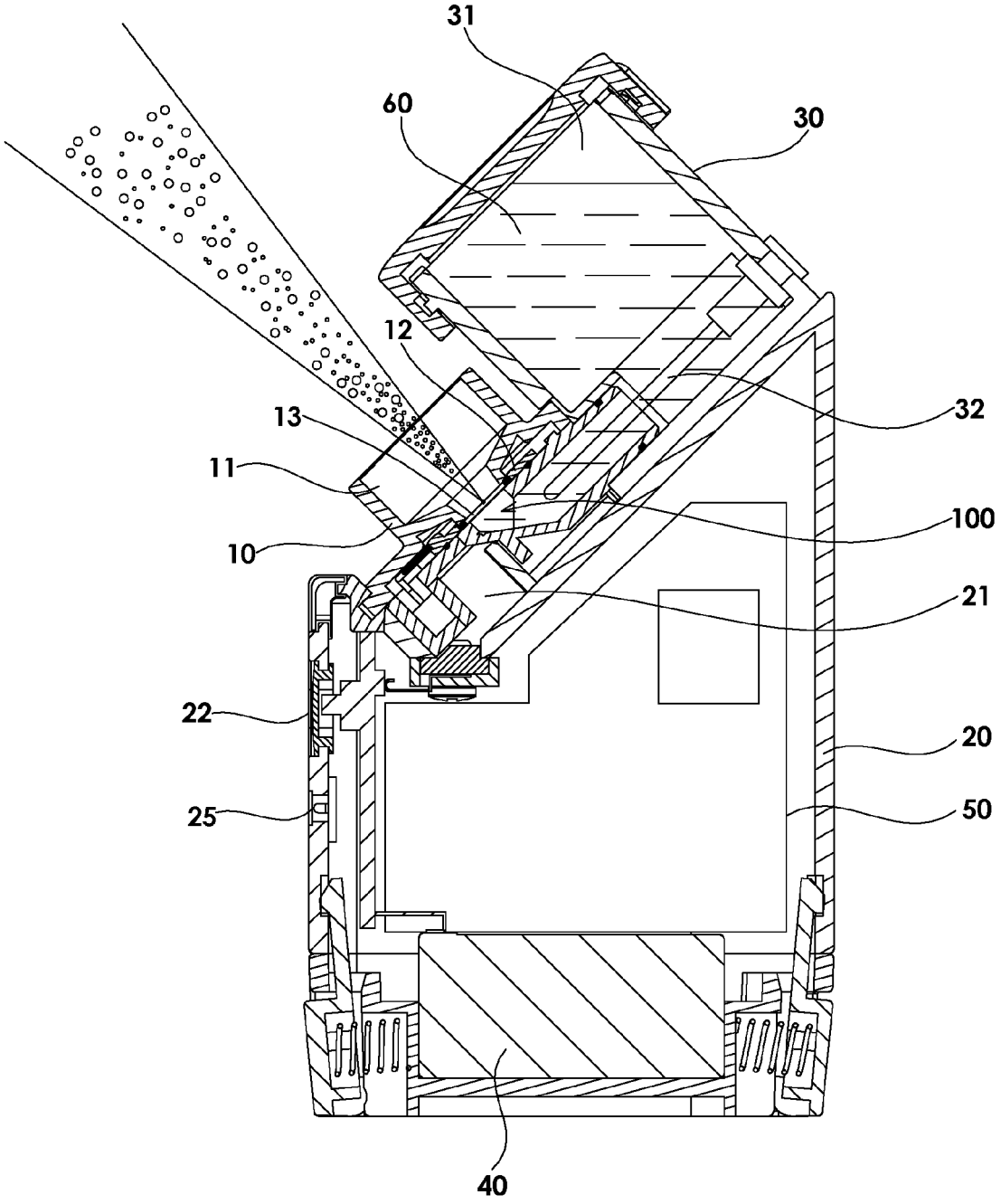
FIG. 4 is a cross-sectional view of the atomizer of FIG. 1.
Figure 5:
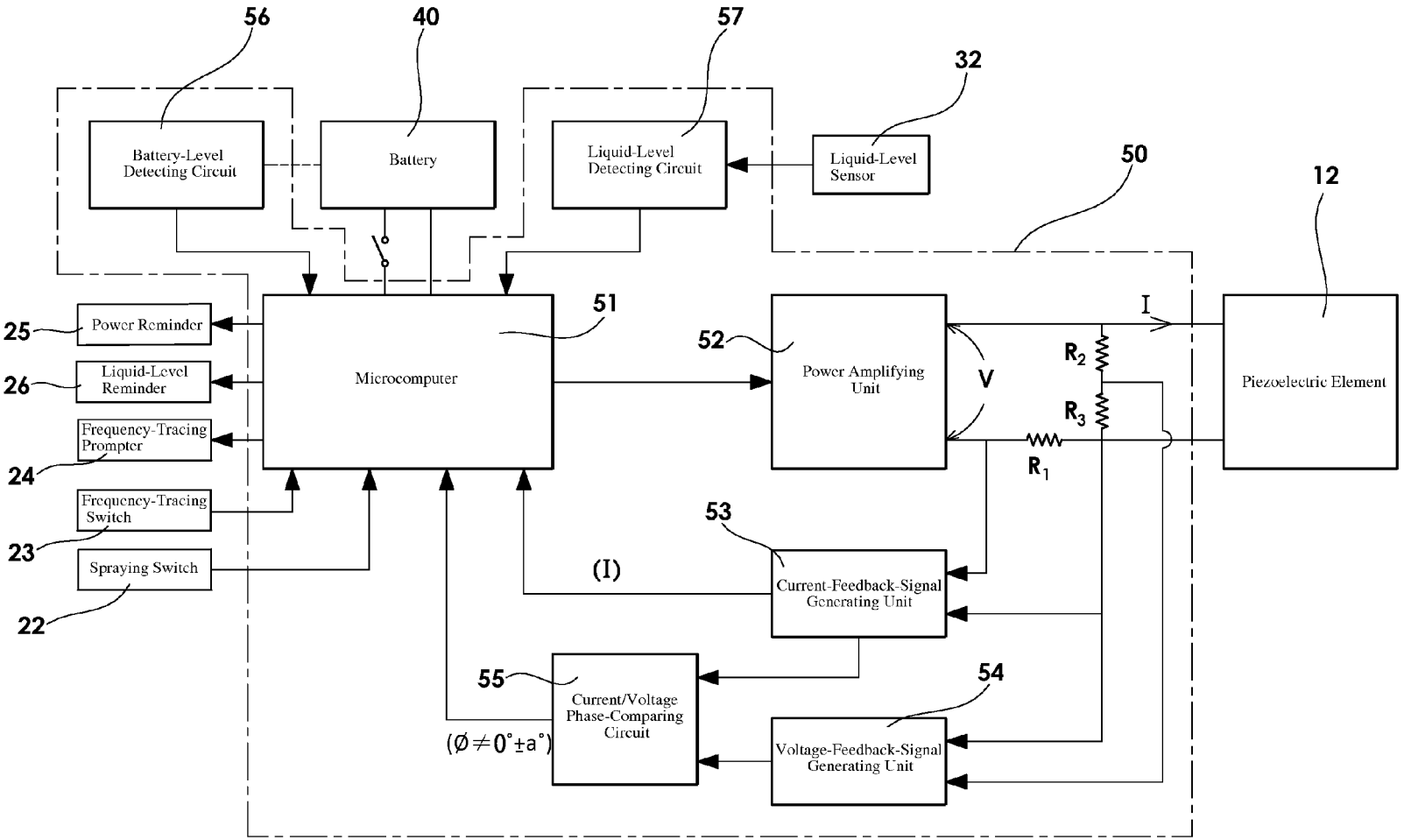
FIG. 5 is a block diagram showing the structure whereby the atomizer's piezoelectric element is adjusted and monitored.

Referring to FIGS. 1, 2, 3, and 4, a nozzle replaceable atomizer with automatic abnormality detecting function according to the invention is shown. The nozzle replaceable atomizer comprises a detachable spray head 10, a main machine 20 and a liquid refill 30. The spray head 10 has a nozzle 11 containing therein a piezoelectric element 12 and a nozzle plate 13 that form a spray-generating portion 100. The main machine 20 has an assembling portion 21 for electrically interfacing the spray head 10, as shown in FIGS. 4 and 5, and has a battery 40 to provide a circuit board 50 therein with working power. The circuit board 50 carries a MCU microcomputer 51, an AMP power amplifying unit 52, a current-feedback-signal generating unit 53, a voltage-feedback-signal generating unit 54, and a current/voltage phase-comparing circuit 55.

As shown in FIGS. 3 and 5, the microcomputer 51 provides a spraying switch 22, a frequency-tracing switch 23 and a frequency-tracing prompter 24 at a surface of the main machine 20. As shown in FIGS. 4 and 5, the power amplifying unit 52 takes the microcomputer 51 as a signal input end thereof and has a bipolar output end electrically connected to the piezoelectric element 12 in the spray head 10, wherein there is a resistor R1 connected in series and two resistors R2, R3 connected is parallel along lines of the bipolar output end. The current-feedback-signal generating unit 53 detects variation of an electric signal across two ends of the resistor R1 connected in series between the power amplifying unit 52 and the piezoelectric element 12, and outputs a current-feedback signal to the microcomputer 51. The voltage-feedback-signal generating unit 54 is electrically connected to the two resistors R2, R3 connected in parallel between the power amplifying unit 52 and detecting the piezoelectric element 12 so as to detect variation of an electric signal between the two resistors R2, R3. The current/voltage phase-comparing circuit 55 obtains a current-waveform feedback signal form the current-feedback-signal generating unit 53 and obtains a voltage-waveform feedback signal from the voltage-feedback-signal generating unit 54, and accordingly generates and outputs a signal for determining current/voltage phase difference for the microcomputer 51.

As shown in FIGS. 1, 2, 3 and 4, the liquid refill 30 is connected to one end of the spray-generating portion 100 of the spray head 10, and has internally a liquid reservoir 31 that is communicated with the spray-generating portion 10 for replenishing a liquid 60.

Referring to FIGS. 3, 4 and 5, when the assembling portion 21 of the main machine 20 has for the first time the spray head 10 assembled thereto or has a spray head 10 newly replaced, by operating the frequency-tracing switch 23, the microcomputer 51 sends out a preset frequency and plural detecting frequencies. The current-feedback-signal generating unit 53 outputs a current-feedback signal for the microcomputer 51 to perform frequency tracing or comparison, so as to automatically set the piezoelectric element 12 at an optimal operating (resonance) frequency. According to the rule that when the frequency f of the AC power output by the power amplifying unit 52 is equal to the natural frequency fR of the piezoelectric element 12 and resonance is achieved (f=fR), the piezoelectric element 12 has the impedance (Z=ohm) is minimal (Min) and the current/voltage phase difference ($\phi$) is zero ($\phi$=0, so the current I is the maximal Max, meaning that the working power of the piezoelectric element 12 is the maximal Max for normal nebulization, during the operation of the atomizer activated by the spraying switch 22, once the current/voltage phase-comparing circuit 55 notices that the current/voltage phase difference ($\phi$) is not zero or not close to zero ($\phi \neq 0° \pm a°$), the microcomputer 51 (NG) triggers the frequency-tracing prompter 24 to inform the user that the frequency-tracing switch 23 has to be operated to redefine the operating (resonance) frequency of the piezoelectric element. If repeated adjustments have been done as failure and the frequency-tracing prompter 24 keeps giving prompts (not able to align with the resonance frequency), the user can be sure that the spray head 10 needs to be maintained or replaced. Thereby, the normal operation of the atomizer can be conveniently managed and maintained in virtue of the automatic frequency-abnormality detection that monitors whether the element 12 is operating at resonance.

According to the embodiment described above, referring to FIGS. 3, 4 and 5, the circuit board 50 in the main machine 20 further comprises a battery-level detecting circuit 56 that detects a remaining power level of the battery 40, and has a signal output end electrically connected to the microcomputer 51, in which the microcomputer 51 provides a power reminder 25 at the surface of the main machine 20. Thereby, when the battery level of the battery 40 becomes low and may hinder the piezoelectric element 12 from normal operation, the battery-level detecting circuit 56 can detect this situation and let the microcomputer 51 trigger the power reminder 25 to inform the user that the battery 40 needs to be replaced with a new one, or the atomizer may fail to work (caused by malfunction of the piezoelectric element 12). The power reminder 25 may be a light-emitting diode that can be turned on to flash or illuminate by the microcomputer 51, so as to indicate that the battery power is about to be low or has been low.

According to the embodiment described above, referring to FIGS. 3, 4 and 5, the circuit board 50 in the main machine 20 further comprises a liquid-level detecting circuit 57, and the liquid reservoir 31 of the liquid refill 30 contains a liquid-level sensor 32 (e.g. a capacitive level sensor) acting as an output end of the liquid-level detecting circuit 57. The output end of the liquid-level detecting circuit 57 is electrically connected to the microcomputer 51 and the microcomputer 51 provides a liquid-level reminder 26 at the surface of the main machine 20. Thereby, when the liquid in the liquid reservoir 31 of the liquid refill 30 gets consumed (over a period of use) to a certain extent, the liquid-level detecting circuit 57 can output a low-level signal to the microcomputer 51 according to the detection of the liquid level in the liquid reservoir 31 performed by the liquid-level sensor 32, so that the microcomputer 51 can trigger the liquid-level reminder 26, to inform that refilling needs to be done. When the liquid reservoir 31 is almost empty, the microcomputer 51 can even stops the spraying switch 22 (for blocking it from activating nebulization) and automatically turns off the piezoelectric element 12, so as to prevent the piezoelectric element 12 and/or the nozzle plate 13 from getting damaged due to waterless operation. The liquid-level reminder 26 may be a light-emitting diode that can be turned on to flash or illuminate by the microcomputer 51, so as to indicate that refilling of the liquid is needed or that nebulization has stopped due to the low liquid level.

According to the embodiment described above, referring to FIGS. 3 and 5, the frequency-tracing prompter 24 provided by the microcomputer 51 at the surface of the main machine 20 is a light-emitting diode that can be turned on to flash or illuminate by the microcomputer 51, so as to indicate that the piezoelectric element 12 (and in turn the spray head 10) is not operating at the operating frequency (nor more normal nebulization) or has failed.

The invention has been described with reference to the preferred embodiments and it is understood that the embodiments are not intended to limit the scope of the invention. Moreover, as the contents disclosed herein should be readily understood and can be implemented by a person skilled in the art, all equivalent changes or modifications which do not depart from the concept of the invention should be encompassed by the appended claims.

While the invention has been described in terms of preferred embodiments, those skilled in the art will recognize that the invention can be practiced with modifications within the spirit and scope of the appended claims.

What is claimed is:

1. A nozzle replaceable atomizer with automatic abnormality detecting function, comprising:

a detachable spray head, having a nozzle containing therein a spray-generating portion that includes a piezoelectric element and a nozzle plate;

a main machine, having an assembling portion for electrically interfacing the spray head, and having a battery to provide a circuit board therein with working power, wherein the circuit board comprises:

a microcomputer, providing a spraying switch, a frequency-tracing switch and a frequency-tracing prompter at a surface of the main machine;

a power amplifying unit, taking the microcomputer as a signal input end thereof and having a bipolar output end electrically connected to the piezoelectric element in the spray head, wherein there is a resistor connected in series and two resistors connected is parallel along lines of the bipolar output end;

a current-feedback-signal generating unit, detecting variation of an electric signal across two ends of the resistor connected in series between the power amplifying unit and the piezoelectric element, and outputting a current-feedback signal to the microcomputer;

a voltage-feedback-signal generating unit, being electrically connected to the two resistors connected in parallel between the power amplifying unit and detecting the piezoelectric element so as to detect variation of an electric signal between the two resistors; and a current/voltage phase-comparing circuit, obtaining a current-waveform feedback signal form the current-feedback-signal generating unit and obtaining a voltage-waveform feedback signal from the voltage-feedback-signal generating unit, and accordingly generating and outputting a signal for determining current/voltage phase difference for the microcomputer; and a liquid refill, being connected to one end of the spray-generating portion of the spray head, and having internally a liquid reservoir that is communicated with the spray-generating portion for replenishing a liquid.

2. The nozzle replaceable atomizer of claim 1, wherein the circuit board in the main machine further comprises a battery-level detecting circuit that detects a remaining power level of the battery, and has a signal output end electrically connected to the microcomputer, in which the microcomputer provides a power reminder at the surface of the main machine.

3. The nozzle replaceable atomizer of claim 2, wherein the power reminder is a light-emitting diode.

4. The nozzle replaceable atomizer of claim 1, wherein the circuit board in the main machine further comprises a liquid-level detecting circuit, and the liquid reservoir of the liquid refill contains a liquid-level sensor acting as an output end of the liquid-level detecting circuit, in which the output end of the liquid-level detecting circuit is electrically connected to the microcomputer and the microcomputer provides a liquid-level reminder at the surface of the main machine.

5. The nozzle replaceable atomizer of claim 4, wherein the liquid-level reminder is a light-emitting diode.

6. The nozzle replaceable atomizer of claim 1, wherein the frequency-tracing prompter provided by the microcomputer at the surface of the main machine is a light-emitting diode.

* * * * *